US005472074A

United States Patent [19]

Milcetic

[11] Patent Number: 5,472,074

[45] Date of Patent: Dec. 5, 1995

[54] COIN OPERATED DISPENSING MACHINE

[76] Inventor: Duncan J. Milcetic, 91 Clapham Ave., Manhasset, N.Y. 11030

[21] Appl. No.: 208,724

[22] Filed: Mar. 9, 1994

[51] Int. Cl.[6] ..... G07F 11/10

[52] U.S. Cl. ..... 194/342; 194/350

[58] Field of Search ..... 194/294, 342, 194/343, 350; 221/240

[56] References Cited

U.S. PATENT DOCUMENTS 1,711,838 5/1929 Goldie ..... 221/240 X
2,902,187 9/1959 Cabanban ..... 221/240
3,540,564 11/1970 Brand .
5,082,101 1/1992 Baker et al. ..... 194/350
5,244,071 9/1993 Lobl ..... 194/342

*Primary Examiner*—F. J. Bartuska
*Attorney, Agent, or Firm*—Collard & Roe

[57] ABSTRACT

A coin-operated vending machine for dispensing lollipops and other irregularly shaped items having several semi-cylindrical vertical chutes of U-shaped cross section, each with a diameter slightly larger than the item. The lollipop stick extends out of a slot extending along one side of the chute. The lollipops exit the bottom of the chutes and rest atop a cradle having a vertical slot therein. A deposited coin is advanced by a plunger through the slot to displace and dispense the lollipop.

19 Claims, 5 Drawing Sheets

COIN OPERATED DISPENSING MACHINE

BACKGROUND OF THE INVENTION

1. Field of the Invention

The present invention relates to a coin operated vending machine for dispensing spherical packages. More specifically, it relates to a coin operated vending machine for dispensing lollipops, spherically shaped perfume bottles and other irregularly shaped objects.

2. The Prior Art

Vending machines are known for dispensing cigarette packs, soda cans and a variety of snacks and candies. One such vending machine is disclosed in U.S. Pat. No. 3,540,564 to Brand which dispenses rectangular products, i.e. cigarette packs, and cylindrical products, i.e. rolls of candy. However, all of the known vending machines are only capable of dispensing packages that are in the shape of a regular rectangle, a regular cylinder or other easily handled package shape. Vending machines have not been manufactured which would allow dispensing of irregularly shaped items, for example, lollipops and perfume bottles. Therefore, it would be desirable to provide a coin operated vending machine that could reliably dispense items having a generally spherical shape and including an irregularly shaped part or handle extending outwardly therefrom.

SUMMARY OF THE INVENTION

It is the purpose of the invention to provide a coin operated vending machine which overcomes the drawbacks of the prior art and can be simply and inexpensively manufactured and maintained.

It is a further object of the present invention to provide a coin operated vending machine which can reliably dispense irregularly shaped packages.

It is yet another object of the present invention to provide a coin operated vending machine for dispensing spherical packages having an irregular shaped part or handle extending outwardly therefrom.

It is still another object of the present invention to provide a coin operated vending machine for dispensing lollipops and perfume bottles.

It is a further object of the present invention to provide a coin operated vending machine with separate stacks of irregularly shaped packages, which allow a selection of the desired package.

These and other relates objects are achieved according to the invention by a coin operated vending machine for irregularly-shaped packages each having a neck or protuberance extending outwardly therefrom. The machine includes a longitudinally extending cylindrical chute having a bottom dispensing end, a spaced opposite top end, and an inner dimension or diameter slightly larger than the package. A longitudinally extending slot extends between the bottom end and the top end and has a width slightly larger than the neck. The packages are loaded into the top end of the chute with the necks positioned at least partially within the slot to maintain alignment and prevent rotation of the packages. Dispensing means are located below the bottom dispensing end of the chute for dispensing a package after a coin is deposited into the vending machine. The chute includes two longitudinally extending edges defining sides of the slot with each edge having a rounded cross-section to facilitate sliding of the packages from the top end to the bottom end. A plurality of chutes are disposed alongside each other, with each of the slots facing in the same direction. The packages may be spherical packages.

The dispensing means includes a cradle for receiving the spherical packages. The cradle has a counter bore on one side thereof facing the bottom dispensing end of the chute and a ridge located at a periphery of the counter bore. The ridge has a rounded cross-section to facilitate the dispensing of the package from the counter bore up and over the ridge. The chute additionally includes the guide member disposed on an interior region of the chute opposite the slot near the bottom dispensing end for guiding the spherical package out of the chute into the cradle.

The cradle has a slot formed therein and the vending machine additionally includes a manually operated plunger adapted for reciprocating movement in alignment with the slot. A coin chute is positioned to direct a deposited coin into a first position between the plunger and the cradle slot. The plunger pushes the coin into the cradle slot to dispense the package disposed on the cradle. The machine further includes coin collection means comprising a first aperture at the first position for selectively collecting deposited coins of an insufficient size or denomination. The coin collection further comprises a second aperture in communication with the cradle slot for collecting the remainder of the deposited coins.

The machine additionally includes a coin ramp located between the first aperture and the second aperture for directing the remainder of the deposited coins into the cradle slot and the second aperture, upon movement of said plunger toward the slot. The coin ramp has an angled surface facing the plunger, a horizontal portion adjacent the angled surface and a rounded surface adjacent the horizontal portion and facing the slot. The horizontal portion is located at least partially below the ridge and the rounded portion is located below the counter bore, so that the directed coin displaces a package located in the cradle as the coin passes along the coin ramp. A weight with an external diameter slightly smaller than the chute is placed on top of the packages to force the packages down the chute.

A coin box having a V-shaped aperture is disposed beneath the cradle slot for receiving the coin, following dispensing of the package. The open end of the V faces the cradle slot. The coin box further includes a pair of parallel plates disposed beneath the V-shaped aperture and extending into the coin box to prevent coins from exiting the coin box through the aperture.

In an alternate embodiment, the coin operated vending machine for dispensing spherical packages includes a cradle having a counter bore therein for receiving the spherical packages and a ridge located at a periphery of the counter bore. The ridge has a rounded cross-section to facilitate dispensing of the package from the counter bore. A dispenser dispenses packages from the cradle following insertion of a coin into the machine. The cradle further includes a slot formed therein and a coin collection aperture in communication with the slot. A deposited coin is directed along the slot to displace and dispense the package located in the cradle before entering the coin collection aperture.

A coin ramp is located below the cradle slot and includes a rounded surface adjacent the coin collection aperture, a flat portion adjacent the rounded surface and an angled ramp portion adjacent the flat portion. The coin ramp raises a deposited coin above the cradle and ridge to displace and dispense the package.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1:
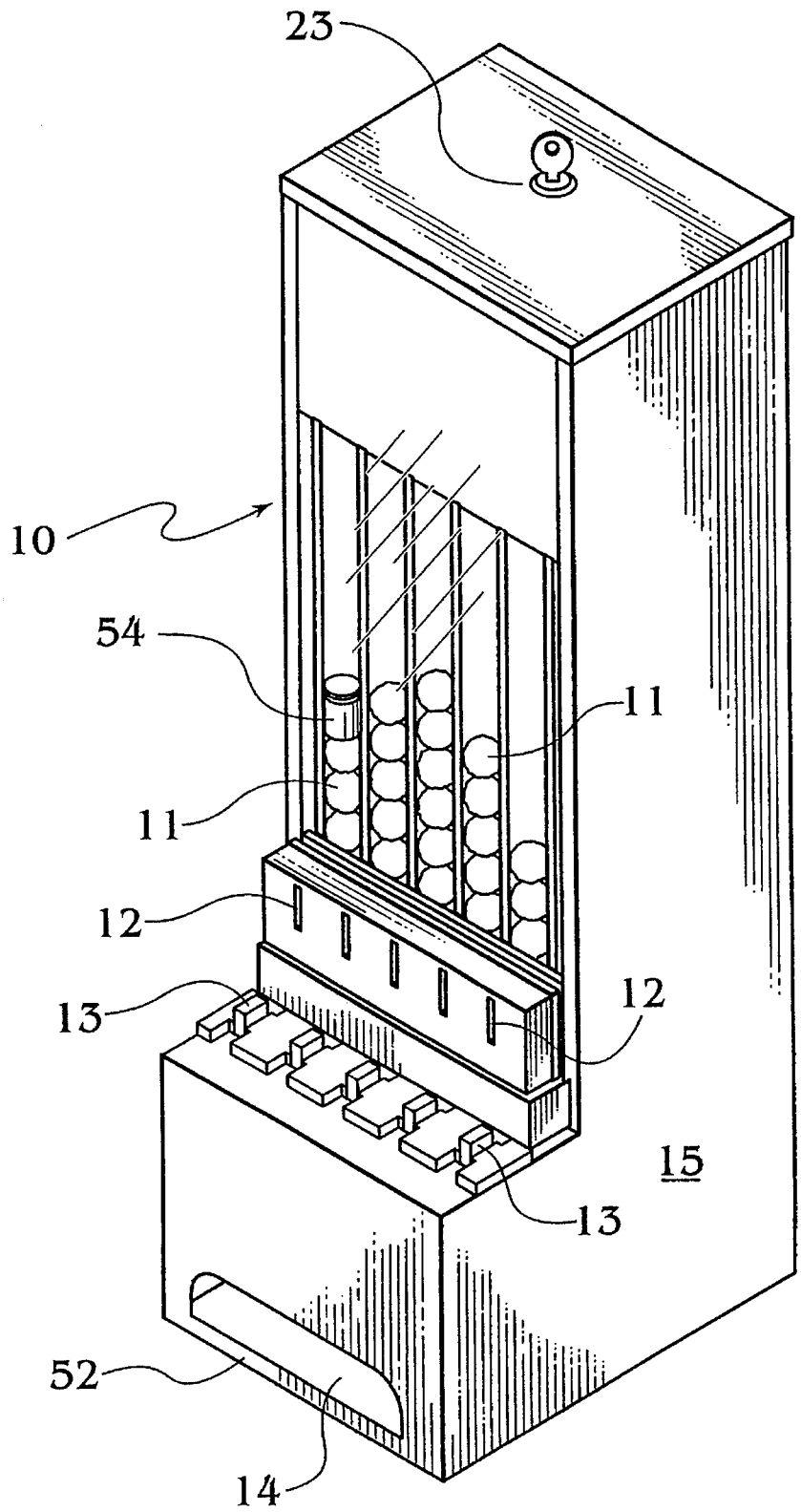
FIG. 1 is a perspective view of an embodiment of a coin-operated vending machine according to the invention.

Referring now in detail to the drawings and, in particular FIG. 1, there is shown an embodiment of a coin-operated vending machine 10 for displaying and dispensing one or several types of merchandise 11. Coins of a particular size and denomination are placed into coin slot 12 and upon actuation of plunger or sliding lever 13, merchandise 11 is dispensed into bin 14. Merchandise 11 is arranged in several side-by-side columns with each column having a respective coin slot 12 and sliding lever 13 for consumer selection of an item from one of the columns of merchandise 11. The components described above and a coin box are all operatively disposed within a housing 15 which is equipped with a lock 23. The top and rear sides of housing 15 form an L-shaped cover which is secured to the remainder of the housing by lock 23. Housing 15 is constructed from welded metal plates, for example.

Figure 2:
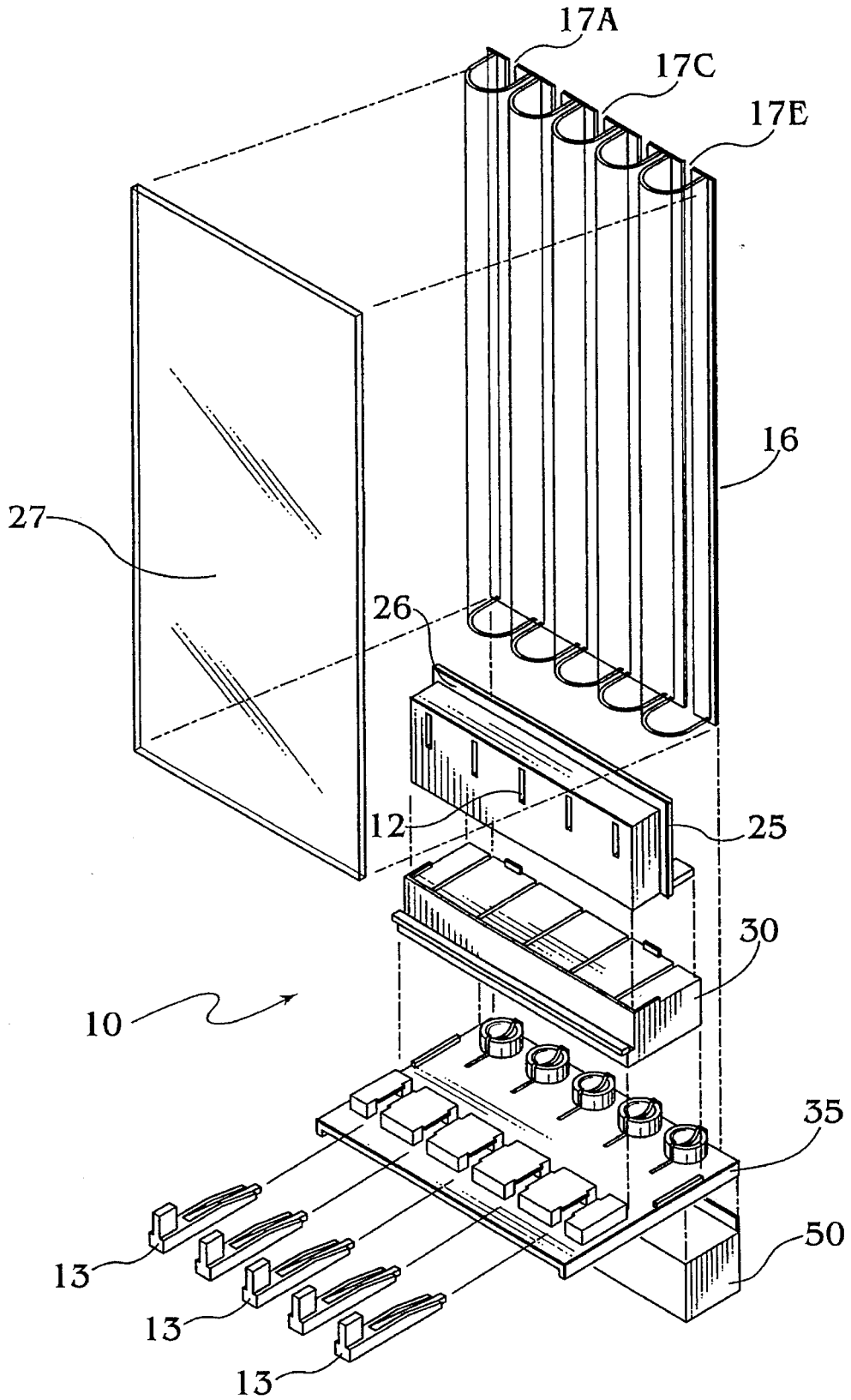
FIG. 2 is an exploded view of the coin-operated vending machine with the outer housing not shown.

Referring now to FIG. 2, various components of coin operated vending machine 10 are shown, with housing 15 not being shown for the sake of clarity. Coin receiving block 25 and coin handling block 30 are mounted on top of a main dispensing panel 35. Display rack 16 is also mounted on main dispensing panel 35 adjacent and to the rear of coin handling block 30. Sliding levers 13 are slidably disposed along the top of main dispensing panel 35 through channels on the bottom of coin handling block 30 and display rack 16. A coin box 50 is secured below main dispensing panel 35. A front plate 27 protects display rack 16 and abuts the top of coin receiving block 25. Front plate 27 is made from clear plexiglass or lexan, for example. Display rack 16 is made from a clear injection-molded plastic while the remaining components are made from opaque injection-molded plastic, for example.

With the top and rear panels of housing 15 removed, main dispensing panel 35 is slid in through the open back end of the housing onto tracks and into its final position shown in FIG. 1. Display rack 16, coin receiving block 25, and coin handling block 30 are then slid down on top of main dispensing panel 35, to lock panel 35 in place. Front plate 27 is then slid down on top of coin receiving block 25 just outside of a flange 26 located on the top of coin receiving block 25. The top and rear panels of housing 15 are then slid into place and locked to securely contain all of the elements within said housing.

Figure 3:
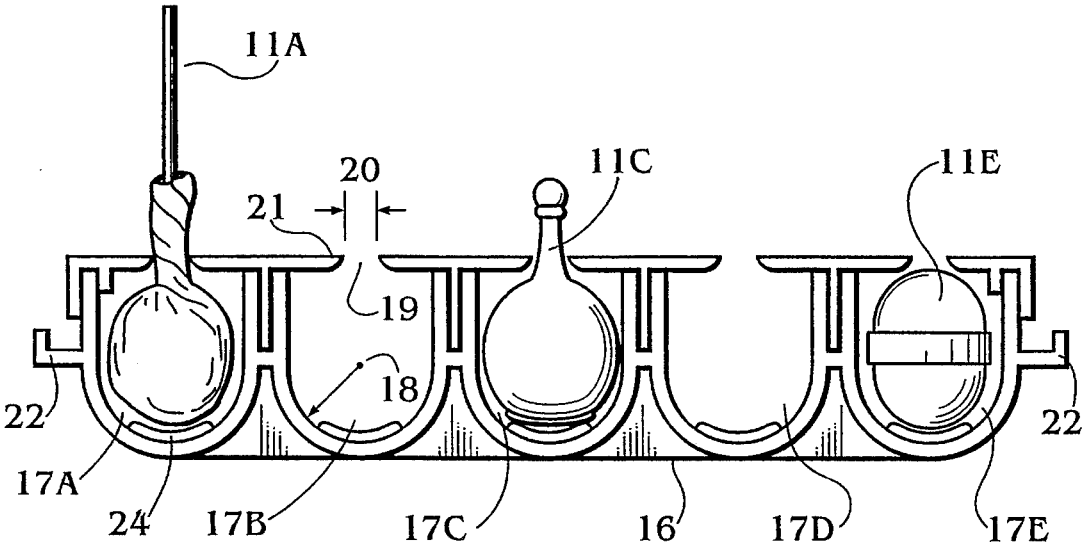
FIG. 3 is a top plan view of the display rack.

Referring now to FIG. 3, display rack 16 is shown with substantially semi-cylindrical chutes 17A, 17B, 17C, 17D and 17E having substantially U-shaped cross sections. Although five uniformly shaped chutes are shown, any number of similar or differently-shaped chutes may be employed within the scope of the invention. Chutes 17 depicted in FIG. 3 are arranged vertically and are designed to accommodate a variety of differently-shaped items 11A, 11C and 11E. Item 11A is a lollipop disposed within chute 17A with the lollipop stick extending outwardly through a slot 19. Each chute 17 has a radius 18 dimensioned slightly larger than the wrapped spherical portion of item 11A. Slot 19 has a width 20 which is slightly larger than the wrapped portion of the stick of item 11A. Edges 21, which border slot 19, are rounded to minimize the surface area which contacts the wrapped stick in order to reduce friction and facilitate the downward movement of items 11 as they are dispensed.

Item 11C is a small bottle having a neck that extends through slot 19. Item 11E is an oval capsule that is disposed completely within chute 17E. Item 11E is a hollow container, for example, which can be separated into two halves by twisting it open. Item 11E allows a wide range of merchandise to be dispensed by vending machine 10. It should be understood that chutes 17 may be configured in a wide range of sizes and shapes to accommodate different types of merchandise. This is accomplished by designing the chutes to generally conform to the shape of the package to be dispensed and leaving a slight clearance therebetween to allow the packages to readily slide down the chutes.

Figure 5:
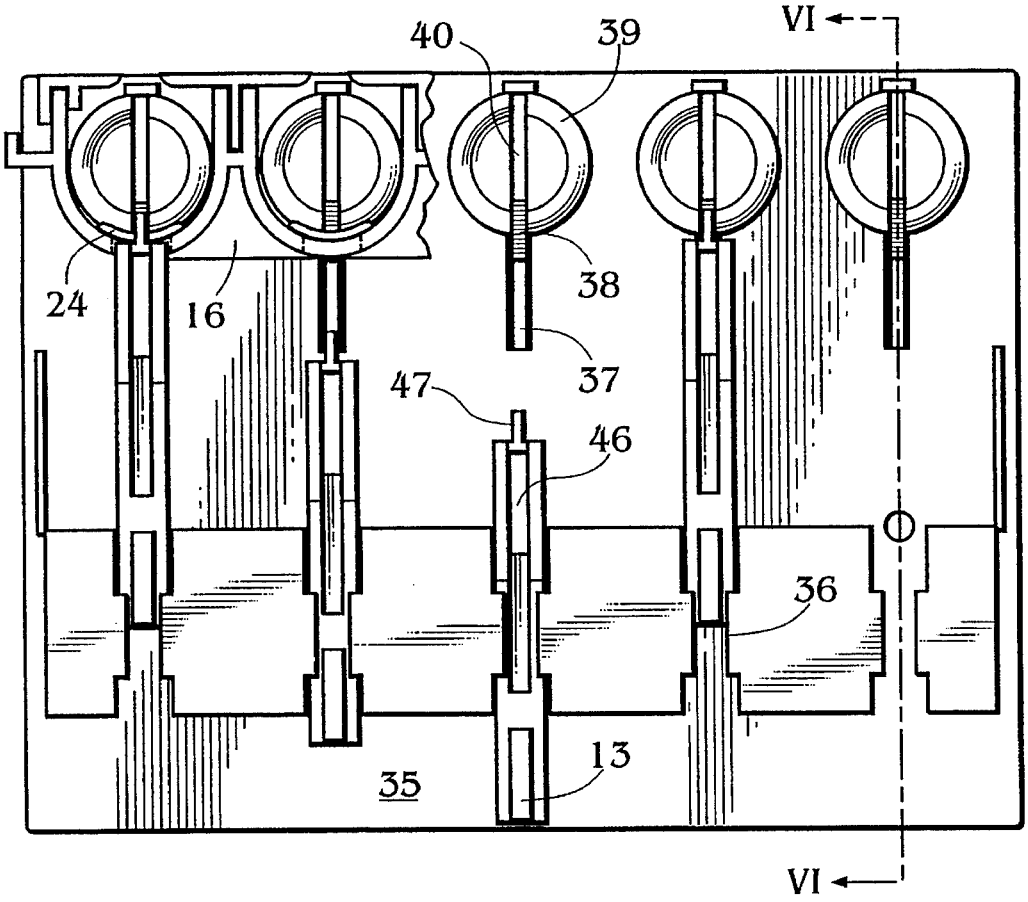
FIG. 5 is a top plan view of the main dispensing panel.

On either end of display rack 16 is an L-shaped bracket 22. These brackets engage correspondingly-shaped slots disposed on the inside facing walls of housing 15. As can be seen in FIGS. 3 and 5, a guide member 24 is located near the bottom end of each chute 17 opposite slot 19. Guide member 24 guides the lowermost item 11 out of the bottom of chute 17 onto a cradle 39.

Figure 4:
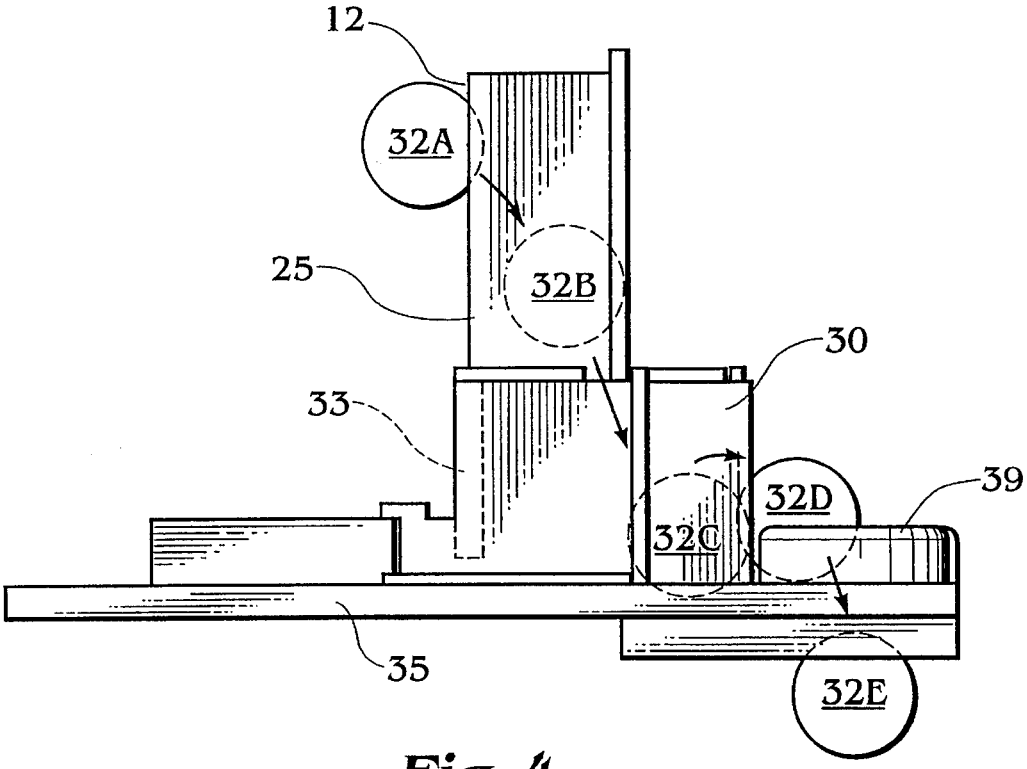
FIG. 4 is a right side elevational view of the coin receiving and merchandise dispensing mechanism showing the coin path.
Figure 6:
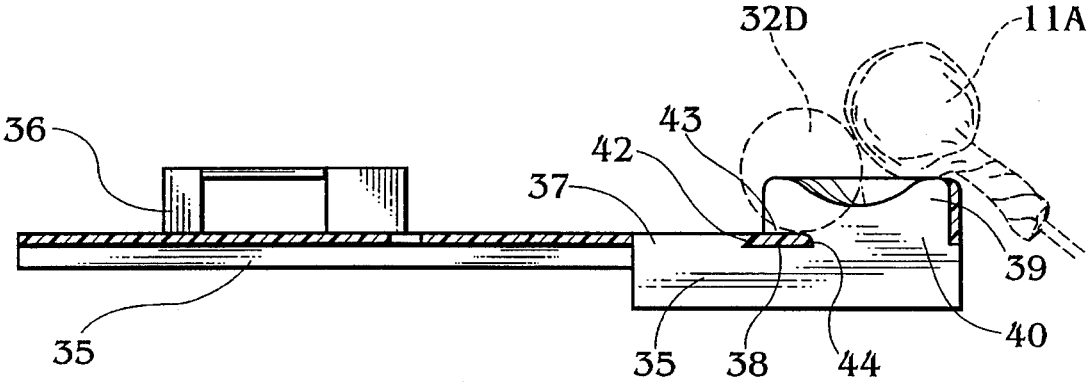
FIG. 6 is a cross-sectional view of the main dispensing panel showing the coin ramp, taken along the line VI—VI of FIG. 5.

Referring now to FIGS. 4, 5 and 6, there is shown coin receiving block 25 disposed on top of coin handling block 30. Blocks 25 and 30 are then mounted onto main dispensing panel 35. Main dispensing panel 35 is provided with lever guides 36 which slidingly receive levers 13 therein.

In use, a coin is placed into one of slots 12 in order to select an item in the chute directly behind that coin slot. As can be seen in FIG. 4, coin 32A is inserted into slot 12 and falls through coin receiving block 25, i.e. through position 32B, ending up in position 32C. Depending on the position of sliding lever 13, as shown in FIG. 5, the coin at position 32C either rests on coin size filter 37 (if lever 13 is retracted) or slot 46 of sliding lever 13. Slot 46 overlies coin size filter 37 when lever 13 is in its forward position, i.e. contacting cradle 39. Slot 46 and coin size filter 37 are approximately the same size and are dimensioned to retain a large coin, for example a quarter, but allow smaller coins of lower denomination to slip through into coin box 50.

If sliding lever 13 is not already retracted, it is then pulled outwardly away from cradle 39. The coin located at position 32C within slot 46 contacts internal wall 33 (shown in FIG. 4) and rolls off sliding lever 13 onto coin size filter 37. As a result, regardless of the initial position of sliding lever 13, the coin always ends up at coin size filter 37 in position 32C with the lever retracted.

Upon forward motion of sliding lever 13 toward cradle 39, the coin is moved from position 32C to position 32D, as can be seen in FIGS. 4 and 6, the forward edge of coin size filter 37 consists of a coin ramp 38. In position 32C, the coin is resting against an angled surface 42. As the coin moves toward cradle 39, it is pushed upward onto horizontal surface 43 where it engages item 11A. As the coin continues to position 32D, item 11A is dispensed off the back end of cradle 39. The coin then rolls off rounded trailing edge 44 of coin ramp 38 and through position 32E into coin box 50. The coin is pushed forward by a nose 47 of sliding lever 13, which can be seen in FIG. 5. Nose 47 moves to a final forward position within coin collection aperture 40 directly above horizontal surface 43.

After item 11A is dispensed off the back end of cradle 39, it falls along a ramp and ends up in bin 14. The lower front edge of housing 15 has a lip 52, as can be seen in FIG. 1, to prevent items 11 from rolling out of bin 14. Optionally, a cylindrical weight 54 is placed on top of selected columns of merchandise to impart an additional downward force to ensure that the items move down as they are dispensed and that the lowermost item rests concentrically on cradle 39. Cylindrical weight 54 is dimensioned to slide easily through chutes 17 and is weighted appropriately to overcome any resistance which may exist between the wrapper of item 11A and the walls of chutes 17 or edges 21.

Figure 7:
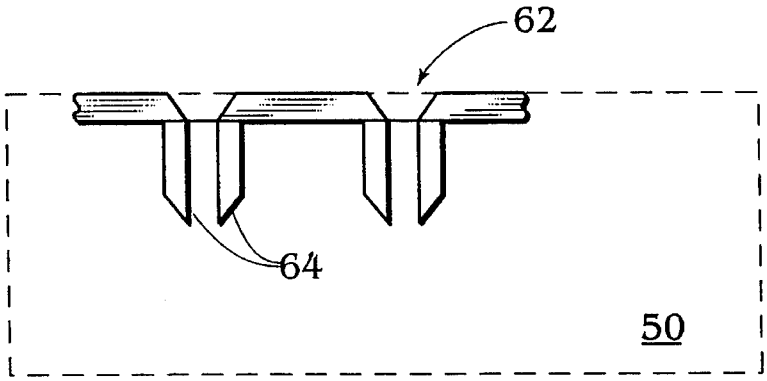
FIG. 7 is a front side view of a coin box, in partial cross-section, showing the coin apertures.

Coins passing through coin size filter 37 or coin collection aperture 40 enter coin box 50 shown in FIG. 7. The top of coin box 50 includes a V-shaped aperture 62 that is located below the cradle slot, i.e. filter 37 and aperture 40. A pair of parallel plates 64 is located beneath aperture 62 and extends into the hollow interior of coin box 50 to guide coins into the box but prevent coins from being easily removed from the box, for example by shaking coin box 50.

While only a single embodiment of the present invention has been shown and described, it is to be understood that many changes and modifications may be made thereunto without departing from the spirit and scope of the invention as defined in the appended claims.

What is claimed is:

1. A coin operated vending machine for dispensing irregularly shaped packages, each having a neck extending outwardly therefrom, the machine comprising:

a longitudinally extending semi-cylindrical chute having:

(i) an inner dimension slightly larger than the package;

(ii) a bottom dispensing end and a spaced opposite top end; and (iii) a longitudinally extending slot extending between said bottom dispensing end and said top end, the slot having a width slightly larger than the neck;

the packages being serially loaded into said top end of said chute with the necks positioned at least partially within the slot to maintain alignment of the packages;

dispensing means located below said bottom dispensing end of said chute for dispensing a package responsive to a coin being deposited into the vending machine; and a guide member disposed on an interior region of said chute opposite the slot and near said bottom dispensing end for guiding the package out of said chute onto said dispensing means.

2. The machine according to claim 1, wherein said chute includes two longitudinally extending edges defining sides of the slot, each edge having a partially rounded cross-section to facilitate sliding of the spherical packages from said top end to said bottom end.

3. The machine according to claim 2, wherein a plurality of chutes are disposed alongside each other, with each of the slots facing in the same direction.

4. The machine according to claim 3, wherein said dispensing means comprises:

a cradle for receiving the spherical package, said cradle having a counter bore on one side thereof facing said bottom dispensing end and a ridge located at a periphery of the counter bore, said ridge having a rounded cross-section to facilitate dispensing of the package from the counter bore up and over said ridge.

5. The machine according to claim 4, wherein said cradle has a slot formed therein and the vending machine includes:

(i) a manually operated plunger adapted for reciprocating movement in alignment with the slot; and (ii) a coin chute positioned to direct a deposited coin into a first position between said plunger and the cradle slot, whereby said plunger is movable to push the coin into the cradle slot to dispense the package disposed on the cradle.

6. The machine according to claim 5, further including:

coin collection means comprising a first aperture at said first position for selectively collecting deposited coins smaller than the first aperture.

7. The machine according to claim 6, said coin collection means further comprising:

a second aperture, larger than the first aperture, in communication with the cradle slot for collecting the remainder of the deposited coins larger than the first aperture.

8. The machine according to claim 7, additionally comprising:

a coin ramp located between the first aperture and the second aperture for directing the remainder of the deposited coins through the cradle slot and into the second aperture, upon movement of said plunger toward the slot.

9. The machine according to claim 5, additionally comprising:

a coin ramp for directing the deposited coin into the slot upon movement of said plunger toward the slot, said coin ramp having an angled surface facing said plunger, a horizontal portion adjacent said angled surface and a round surface adjacent said horizontal portion and facing the slot.

10. The machine according to claim 9, wherein said coin ramp is located at least partially beneath said cradle to raise the directed coin above said cradle so that the directed coin displaces a package located in said cradle as the coin passes along said coin ramp.

11. The machine according to claim 10, further comprising a coin box having a V-shaped aperture disposed beneath the cradle slot for receiving the coin following dispensing of the package, the open end of the V facing the cradle slot.

12. The machine according to claim 11, said coin box further including a pair of parallel plates disposed beneath the V-shaped aperture and extending into said coin box to prevent coins from exiting said coin box through the aperture.

13. The machine according to claim 12, further comprising a weight with an external dimension slightly smaller than said chute, said weight is placed on top of the packages to force the packages down the chute.

14. A coin operated vending machine for dispensing spherical packages, the machine comprising:

a cradle having (i) a counter bore therein for receiving the spherical packages; and (ii) a ridge located at a periphery of the counter bore having a rounded cross-section to facilitate dispensing of the package from the counter bore; and means for dispensing packages from said cradle following insertion of a coin into said machine, said means for dispensing packages comprising a coin ramp disposed partially beneath said cradle for raising the coin above said cradle to contact and displace a spherical package.

15. The machine according to claim 14, wherein said cradle further includes a slot formed therein and a coin collection aperture in communication with the slot, wherein a deposited coin is directed along the slot to displace and dispense the package located in the cradle before entering the coin collection aperture.

16. The machine according to claim 15, wherein said coin ramp comprises:

(i) a rounded surface adjacent the coin collection aperture;

(ii) a flat portion adjacent said rounded surface; and (iii) an angled ramp portion adjacent said flat portion.

17. The machine according to claim 16, wherein said flat portion of said coin ramp is disposed partially beneath said cradle ridge.

18. The machine according to claim 16, wherein said rounded surface of said coin ramp is disposed beneath said cradle counter bore.

19. A coin operated vending machine for dispensing spherical packages having a neck extending outwardly therefrom, the machine comprising:

a plurality of longitudinally extending semi-cylindrical chutes disposed alongside each other, each of said chutes having:

(i) an inner dimension slightly larger than the package;

(ii) a bottom dispensing end and a spaced opposite top end;

(iii) a longitudinally extending slot extending between said bottom end and said top end, the slot having a width slightly larger than the neck; and (iv) two longitudinally extending edges defining sides of the slot, each edge having a partially rounded cross-section to facilitate sliding of the spherical packages from said top end to said bottom end; and the packages being serially loaded into said top ends of said chutes with the necks positioned at least partially within the slots to maintain alignment of the packages, all of the slots facing in the same direction;

dispensing means located below each of said bottom dispensing ends of said chutes for dispending a package responsive to a coin being deposited into the vending machine, said dispensing means comprising a cradle for receiving the spherical package, said cradle having a counterbore on one side thereof facing said bottom dispensing end and a ridge located at a periphery of the counterbore, said ridge having a rounded cross-section to facilitate dispensing of the package from the counter bore up and over said ridge; and a guide member disposed on an interior region of each of said chutes opposite the slot and near said bottom dispensing end for guiding the spherical package out of said chute onto said cradle.

* * * * *